United States Patent [19]

Blanchard

[11] Patent Number: 4,501,562

[45] Date of Patent: Feb. 26, 1985

[54] MARINE PROPULSION DEVICE FOR SAILBOATS

[75] Inventor: Clarence E. Blanchard, Kenosha, Wis.

[73] Assignee: Outboard Marine Corporation, Waukegan, Ill.

[21] Appl. No.: 527,012

[22] Filed: Aug. 29, 1983

Related U.S. Application Data

[62] Division of Ser. No. 211,530, Dec. 1, 1980, abandoned.

[51] Int. Cl.[3] ..... B63H 5/12

[52] U.S. Cl. ..... 440/61; 248/642

[58] Field of Search ..... 440/53-63, 440/65; 248/641, 642, 640, 643; 114/162, 165

[56] References Cited

U.S. PATENT DOCUMENTS

| | | | |
|---|---|---|---|
| 1,374,095 | 4/1921 | Owen | 440/55 |
| 1,460,570 | 7/1923 | Buehner | 440/56 |
| 1,800,135 | 4/1931 | Corcoran | 440/53 |
| 2,178,555 | 11/1939 | Briggs | 114/162 |
| 2,908,242 | 10/1959 | Forbes | 440/61 |
| 2,916,009 | 12/1959 | Baird | 248/641 |
| 2,939,658 | 6/1960 | Roemer | 248/641 |
| 3,029,770 | 4/1962 | Anderson | 440/61 |
| 3,096,058 | 7/1963 | Torre | 248/642 |
| 3,096,959 | 7/1963 | Wagner | 440/61 |
| 3,421,723 | 1/1969 | Holt | 248/642 |
| 3,486,724 | 12/1969 | Adamski | 440/61 |
| 3,581,702 | 6/1971 | Moberg | 440/61 |
| 3,648,645 | 3/1972 | Ezell | 440/62 |
| 3,683,841 | 8/1972 | Krautkremer | 440/61 |
| 3,809,343 | 5/1974 | Adams | 440/61 |
| 3,839,986 | 10/1974 | Meyer | 440/61 |
| 4,044,705 | 8/1977 | Roberts | 440/61 |
| 4,076,193 | 2/1978 | Weaver | 440/55 |
| 4,143,614 | 3/1979 | Jeanson | 440/61 |
| 4,232,627 | 11/1980 | Glenn et al. | 248/641 |

*Primary Examiner*—Trygve M. Blix
*Assistant Examiner*—Jesûs D. Sotelo
*Attorney, Agent, or Firm*—Michael, Best & Friedrich

[57] ABSTRACT

Disclosed herein is a marine propulsion device comprising a transom bracket adapted to be mounted on the transom of a boat, a propulsion unit assembly including a rotatably mounted propelling element, and linkage connecting the propulsion unit assembly and the transom bracket for movement of the propulsion unit assembly relative to the transom bracket between a running position and a second elevated position spaced from the running position and against other material movement of the propulsion unit assembly relative to the transom bracket.

5 Claims, 6 Drawing Figures

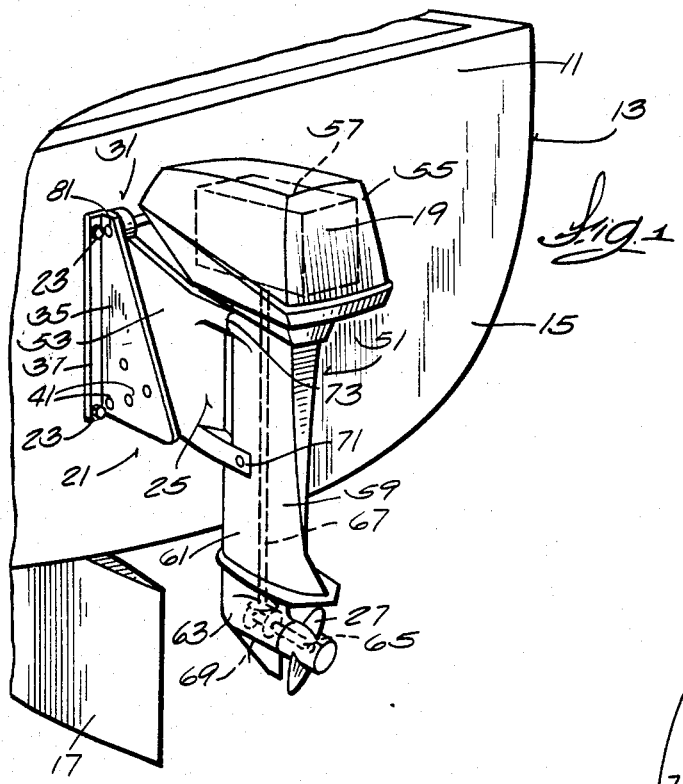
Fig. 1
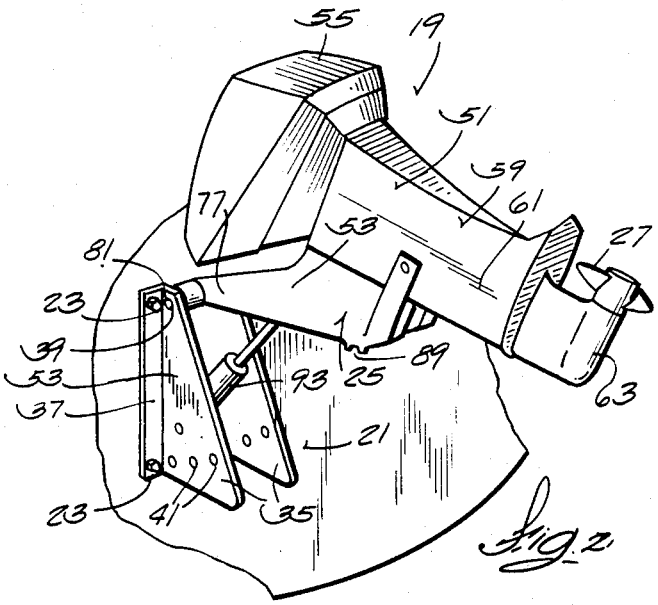
Fig. 2
Fig. 3
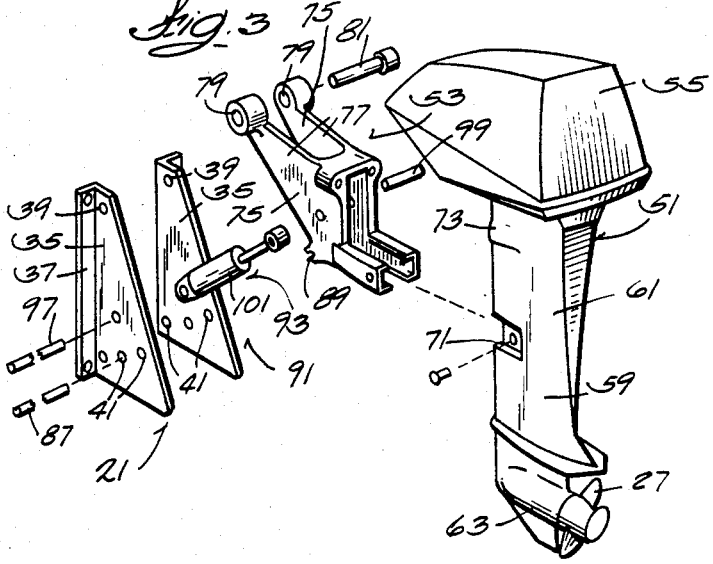

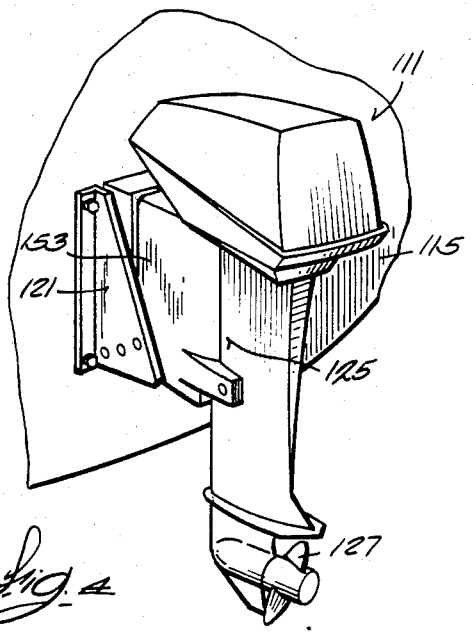
Fig. 4
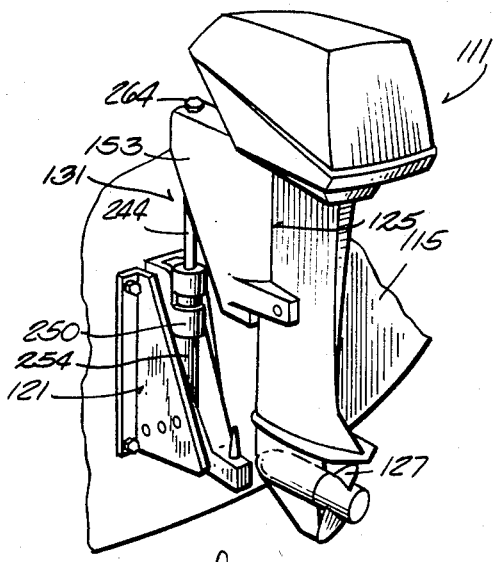
Fig. 5
Fig. 6
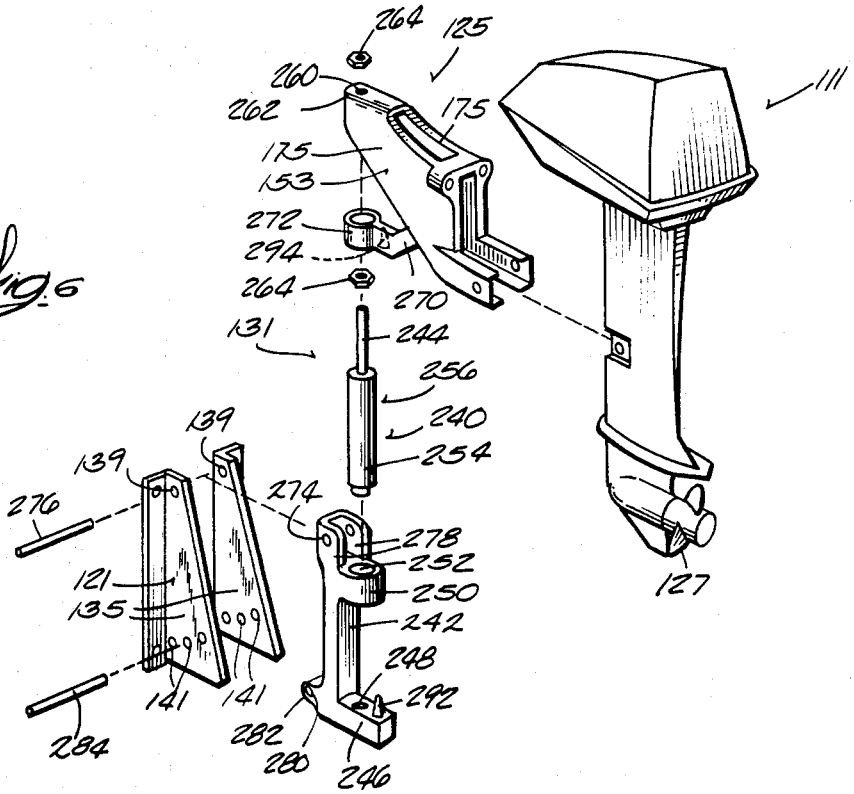

MARINE PROPULSION DEVICE FOR SAILBOATS

RELATED APPLICATION

This application is a division of application Ser. No. 211,530, filed Dec. 1, 1980, and now abandoned.

Attention is directed to my related pending application Ser. No. 211,642, filed Dec. 1, 1980 and entitled: STEERING POST MOUNTED PROPULSION ASSEMBLY.

BACKGROUND OF THE INVENTION

The invention relates generally to marine propulsion devices and, more particularly, to marine propulsion devices adapted for propelling sailboats which are commonly steered by a rudder located either under the hull or behind the transom.

In the past, outboard motors have sometimes been mounted on the transom of a sailboat, but, in general, such mounting has been relatively inaccessible, and consequently, the steering capability of the outboard motor has seldom been used and the propeller was often undesireably trailed in the water when the boat was under sail.

Attention is diverted to the following U.S. Patents:

| | | | |
|---|---|---|---|
| Jeanson | 4,143,614 | issued | March 13, 1979 |
| Krautkremer | 3,683,841 | issued | Aug. 15, 1972 |
| Adams | 3,809,343 | issued | May 7, 1974 |
| Moberg | 3,581,702 | issued | June 1, 1971 |
| Roberts | 4,044,705 | issued | Aug. 30, 1977 |
| Wagner | 3,096,959 | issued | July 9, 1963 |
| Forbes | 2,908,242 | issued | Oct. 13, 1959 |
| Briggs | 2,178,555 | issued | Nov. 7, 1939 |
| Corcoran | 1,800,135 | issued | April 7, 1931 |

SUMMARY OF THE INVENTION

The invention provides a marine propulsion device comprising a transom bracket adapted to be mounted on the transom of a boat, a propulsion unit assembly including a rotatably mounted propelling element, and means connecting the propulsion unit assembly and the transom bracket for movement of the propulsion unit assembly relative to the transom bracket between a running position and a second or elevated position spaced from the running position and against other material movement of the propulsion unit assembly relative to the transom bracket.

In one embodiment of the invention, the means connecting the propulsion unit assembly and the transom bracket includes means for pivotally connecting the propulsion unit assembly to the transmission bracket about an axis which is horizontal when the transom bracket is boat mounted and for selectively displacing the propulsion unit assembly relative to the transom bracket between the running position and the spaced position.

In one embodiment of the invention, the means connecting the propulsion unit assembly and the transom bracket includes means for selectively rectilinearly displacing the propulsion unit assembly relative to the transom bracket between the running position and the second position.

In one embodiment of the invention, the means for selectively and rectilinearly displacing the propulsion unit assembly displaces the propulsion unit assembly generally vertically.

In one embodiment of the invention, the means for selectively and rectilinearly displacing the propulsion unit assembly comprises a link which is extensible and contractable and which is connected, at one end, to the transom bracket and connected, at the other end, to the propulsion unit assembly.

In one embodiment of the invention, the means for selectively rectilinearly displacing the propulsion unit assembly further includes means for preventing pivotal movement in a vertical plane of the propulsion unit assembly with respect to the link.

In one embodiment of the invention, the means connecting the propulsion unit assembly to the transom bracket further includes means pivotally connecting the link to said transom bracket and releasable means for holding the link against pivotal movement relative to the transom bracket in any selected one of a plurality of angularly displaced locations relative to the transom bracket.

Other features and advantages of the embodiments of the invention will become known by reference to the following general description, claims and appending drawings.

IN THE DRAWINGS

FIG. 1 is a perspective view of one embodiment of an outboard motor installation which embodies various of the features of the invention and which is shown with the outboard motor in the running position.

FIG. 2 is a perspective view of the outboard motor installation shown in FIG. 1 with the outboard motor shown in the raised position.

FIG. 3 is an exploded perspective view of the outboard motor shown in FIG. 1.

FIG. 4 is a perspective view of a second embodiment of an outboard motor installation which embodies various of the features of the invention and which is shown with the outboard motor in the running position.

FIG. 5 is a perspective view of the outboard motor installation shown in FIG. 4 with the outboard motor shown in raised position.

FIG. 6 is an exploded perspective view of the outboard motor shown in FIG. 4.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIGS. 1 through 3 is a marine propulsion installation 11 comprising a boat hull 13 including a transom 15 and means (not shown) mounting a rudder 17 for steering movement beneath the hull 13, together with a marine propulsion device 19 which includes a transom bracket 21 secured to the boat transom 15 by any suitable means, such as by a plurality of bolts 23, and a propulsion assembly 25 which includes a rotatably mounted propelling element, such as a propeller 27, and means 31 connecting the propulsion assembly 25 relative to the transom bracket for movement of the propulsion assembly relative to the transom bracket 21 between a running position (See FIG. 1) with the propeller 27 in the water, and a second or elevated or raised position (See FIG. 2) which is spaced from the running position and desirably locates the propeller 27 out of the water, and against other material movement of the propulsion assembly 25 relative to the transom bracket 21, i.e., against steering movement.

The transom bracket 21 can be of unitary construction or can comprise several individual pieces, and includes a pair of laterally spaced wing portions 35 which extend rearwardly and generally in parallel relation to each other from connected mounting flanges 37 through which the bolts 23 extend.

The wing portions 35 can be generally in the form of a 30°-60°-90° triangle with the 30° angle being located at the top and with the 60° angle being located at the bottom and rearwardly of the transom 15.

As will be referred to hereinafter, the wing portions 35 include, adjacent the top thereof, respective, laterally aligned bores 39, and adjacent the bottom thereof, respective, laterally aligned series of spaced bores 41, which extend in an arcuate array and which have a common radius from the upper bore 39.

The propulsion assembly 25 comprises a propulsion unit 51 which includes the propeller 27 and which can be generally of conventional construction, together with a connecting bracket 53 which is fixedly secured to the propulsion unit 51 against relative movement therebetween except that elastomeric mounts (not shown) are preferably employed between the connecting bracket 53 and the propulsion unit 51 so as to vibrationally isolate the connecting bracket 53 from the propulsion unit 51. As a consequence, minor immaterial movement of the propulsion unit 51 relative to the connecting bracket 53 is afforded. However, for practical purposes, the propulsion unit 51 and connecting bracket 53 are rigidly secured together.

The propulsion unit 51 comprises a powerhead 55 including an internal combustion engine 57, together with a lower unit 59 which includes a drive shaft housing 61 rigidly secured to the bottom of the powerhead 55, and a gear case 63 which is rigidly secured to the bottom of the drive shaft housing 61 and which rotatably supports a propeller shaft 65 carrying the propeller 27. Extending through the drive shaft housing 61 is a drive shaft 67 which is drivingly connected to the engine 57 and to a reversing transmission 69 located in the gear case 63 and connected to the propeller shaft 65. As already indicated, the construction of the propulsion unit 51 is generally conventional.

The connecting bracket 53 is connected to the drive shaft housing 61 at vertically spaced points, indicated generally at 71 and 73, and extends forwardly and upwardly therefrom by means including a pair of laterally spaced legs 75 having forwardly and upwardly located end portions 77 including respective, laterally aligned transverse bores 79. The legs 75 are laterally spaced apart at a distance less than the wing portions 35 of the transom bracket 21 so as to permit disposition of the connecting bracket legs 75 in inwardly adjacent relation to the wing portions 35 of the transom bracket 21 for transmission therebetween of side thrust.

While various constructions can be employed for connecting the propulsion assembly 25 to the transom bracket 21 for pivotal movement of the propulsion unit assembly 25 relative to the transom bracket 21 between the running position and the raised or tilt position, in the illustrated construction, such means 31 comprises the before mentioned bores 39 and 79, and (See FIG. 3) a tilt pin 81 which extends horizontally and through the bores 39 and 79 and which, together with the bores 39 and 79, prevents relative movement between the propulsion assembly 25 and the transom bracket 15 except for the just mentioned pivotal tilting movement. More specifically, the connection of the propulsion assembly 25 to the transom bracket 21 does not provide for steering movement of the propulsion assembly 25 relative to the transom bracket 21.

The marine propulsion device 19 also includes means for selectively adjusting the angular position of the propulsion assembly 25 to the transom bracket 21 when the propulsion assembly 25 is in the running position. While various arrangements can be employed, in the illustrated construction, such means comprises, in addition to the series of bores 41, a thrust pin 87 which is selectively positionable in any one pair of laterally aligned bores 41 and a thrust pin engaging portion 89 on the connecting bracket 53 which releasably engages the thrust pin 87 for transmission of thrust to the transom bracket 21 and thus to the boat hull 13.

Means 91 are also provided for selectively tiltably displacing the propulsion assembly 25 upwardly about the horizontal tilt axis from the lowered running position to the elevated or raised tilt position with the propeller 27 desirably located out of the water. While various arrangements can be employed, in the illustrated construction, such means 91 comprises a link 93 which is expansible and contractable, which, at one end, is pivotally connected by a pin 97 to the connecting bracket 53, and which, at the other end, is pivotally connected to the connecting bracket 53 by a pin 99.

Any suitable expandable link can be employed. In the illustrated construction, the link 93 comprises a hydraulic cylinder-piston assembly. Any suitable means (not shown) can be employed for controllably supplying to and draining pressure fluid from the opposite ends of the cylinder 101 so as to pivotally displace the propulsion assembly 25 between the lowered running position and the raised tilt position with the propeller 27 out of the water. The running position is determined by engagement of the thrust pin engaging portion 89 of the connecting bracket 53 with the thrust pin 87 and, in view of the availability of selective disposition of the thrust pin 87 in any one of the several pairs of laterally aligned bores 41 in the transom bracket 21, a series of running positions is provided.

Shown in FIGS. 4, 5, and 6 is another marine propulsion device 111 which is fixed to a boat transom 115 by a transom bracket 121 and which includes a propulsion assembly 125 which is connected to the transom bracket 121 for displacement between a first lowered running position (See FIG. 4) and a second elevated or raised tilt position (See FIG. 5) and against steering movement relative to the transom bracket 121.

The construction of the transom bracket 121 is generally identical to the construction of the transom bracket 21 disclosed with respect to the embodiment shown in FIG. 1 and thus no further description will be provided. In addition, the construction of the propulsion assembly 125 is generally identical to the construction of the propulsion assembly 25 shown in FIG. 3, except as will be explained hereinafter. Accordingly, except for disclosure hereinafter, it is understood that the propulsion assembly 125 is otherwise identical to the propulsion assembly 25 and no further general description will be provided.

In the embodiment shown in FIGS. 4, 5, and 6, the means 131 connecting the transom bracket 121 to the propulsion assembly 125 for displacing the propulsion assembly 125 between the lowered running position and the raised or elevated position comprises an extendable bracket assembly 240 including a bracket 242 and a member 244 which is extendable and retractable relative to the bracket 242, together with means connecting the outer end of the extendable member 244 to the upper end of the connecting bracket 153 of the propulsion assembly 125. In addition, the connecting means 131 also includes means preventing pivotal movement of the propulsion assembly 125 relative to the bracket assembly 240 in the vertical plane and guidance of recilinear movement of the propulsion assembly 125 vertically relative to the transom bracket 121, together with means for pivotally connecting the bracket assembly 240 to the transom bracket 121 for pivotal movement of the bracket assembly 240 relative to the transom bracket 121 about a horizontal axis, and means for releasably retaining the bracket assembly 240 in one of a plurality of angularly displaced running positions relative to the transom bracket 121.

While various constructions can be employed, in the construction illustrated in FIGS. 4, 5 and 6, the bracket 242 is elongated and includes, at the lower end thereof, a rearwardly extending foot 246 having therein a socket 248. The bracket 242 also includes, in spaced relation above the foot 246, a rearwardly extending arm 250 having therein an annular socket 252. Received in the sockets 248 and 252 in spaced parallel relation to the bracket 242 is a cylinder 254 forming a part of a cylinder-piston assembly 256 which also includes a piston rod which constitutes the extendable member 244. Any suitable means, such as one or more set screws or clamps (not shown), can be employed for fixedly connecting together the bracket 242 and the cylinder 254. If desired, the bracket 242 and the cylinder 254 can be unitarily constructed in one piece.

While various other arrangements can be employed to connect the upper end of the piston rod or extendible member 244 to the connecting bracket 153, in the illustrated construction, the upper end of the piston rod 244 is threaded and extends through an aperture 260 in a horizontally extending web 262 connecting the upper ends of the connecting bracket legs 175. The bores 79 shown in FIG. 3 can be omitted. The piston rod 244 is fixed to the connecting bracket or member 153 by locking nuts 264 threaded onto the piston rod 244 above and below the web 262.

While various arrangements can be employed for preventing pivotal movement of the propulsion assembly 125 in the vertical plane relative to the bracket assembly 240 and for guiding rectilinear vertical movement of the propulsion assembly 125 relative to the bracket assembly 240, in the embodiment disclosed in FIGS. 4, 5 and 6, such means comprises construction of the connecting bracket 153 with a downwardly and forwardly extending leg 270 having at its outer end, a ring portion 272 which encircles the cylinder 254 so as to both prevent pivotal movement in the vertical plane and to guide vertical rectilinear movement of the propulsion assembly 125 relative to the bracket assembly 240 and relative to the transom bracket 121. As illustrated, the ring portion 272 extends, in part; between the cylinder 254 and the bracket 242.

While various other arrangements can be employed, in the illustrated construction, the means for pivotally connecting the bracket assembly 240 to the transom bracket 121 includes, in addition to the aligned bores 139 at the top of the transom bracket 121, formation of the bracket 242 with a bore 274 at the top thereof, and projection through the bores 139 and 274 of a pivot pin 276 so as to establish a horizontal tilt axis between the bracket assembly 240 and the transom bracket 121. Preferably, the upper end of the bracket assembly 240 includes two laterally spaced legs 278 which include the bore 274 and which are inwardly adjacently located with respect to the wing portions 35 of the transom bracket 121 so as to prevent lateral movement of the bracket assembly 240 relative to the transom bracket 121 along the axis of the pivot pin 276.

While various other arrangements can be employed, in the disclosed construction, the means for releasably retaining the bracket assembly 240 in a selected one of several angularly displaced running positions comprises, in addition to the series of aligned pairs of bores 141 in the wing portions 135 of the transom bracket 121, formation of the lower end of the bracket 242 with a forwardly extending lug 280 having a transverse thickness approximately equal to the distance between the wing portions 135 and provided with a transverse aperture or bore 282, together with a locking pin 284 which is releasably insertable in one of the laterally aligned pairs of bores 141 in the wing portions 135 and through the bore 282 in the lug 280 to retain the bracket assembly 240 against pivotal movement relative to the transom bracket 121 and in a selected one of several angularly displaced bracket running positions.

It is noted that, in the embodiment shown in FIGS. 4, 5 and 6, the thrust pin engaging portion 89 provided on the connecting bracket 53 illustrated in FIG. 3 is omitted on the connecting bracket 153 illustrated in FIG. 6.

In order to increase the rigidity of the connection of the propulsion assembly 125 to the bracket assembly 240 when the propulsion assembly 125 is in its lower running position relative to the bracket assembly 240, the foot 246 on the bracket assembly 240 and the undersurface of the connecting bracket 153 are provided with interfitting pilot means. More specifically, while other constructions could be employed, in the illustrated construction, such means comprises a conical pilot 292 on one of the foot 246 of the bracket assembly 240 and the connecting bracket 153 (on the foot 246 in the disclosed construction) and a mating aperture 294 in the other of the foot 246 and connecting bracket 153 (in the leg 270 of the connecting bracket 153 in the disclosed construction). Thus, when the connecting bracket 153 is displaced toward its lower running position, the conical pilot 292 enters into the aperture 294 to provide additional rigidity.

Any suitable means (not shown) can be employed to controllably supply hydraulic fluid to the opposite ends of the cylinder 254 so as to displace the propulsion assembly 125 between the raised out-of-the water position and the lowered running position with the propeller 127 in the water. Furthermore, when in the running position, the pilot 292 interfits with the aperture 294 in the connecting bracket 153 to provide further rigidification between the connecting bracket 153 and the bracket assembly 240. In addition, several running positions at differing angular inclinations are available by removing the locking pin 284 from one laterally aligned pair of the bores 141 in the transom bracket 121, by realigning the bore 282 with another laterally aligned pair of bores 141 in the transom bracket 121, any by reinserting the locking pin 284 through the newly aligned bores.

Various of the features of the invention are set forth in the following claims.

I claim:

1. A marine propulsion device comprising a transom bracket adapted to be mounted on the transom of a boat, a propulsion unit assembly including a rotatably mounted propelling element, and means connected to said propulsion unit assembly and said transom bracket for selectively rectilinearly displacing said propulsion unit assembly relative to said transom bracket between a running position and a second elevated position spaced from the running position and against other material movement of said propulsion unit assembly relative to said transom bracket, said means for selectively rectilinearly displacing said propulsion unit assembly comprising a link which is extensible and contractable and which is connected between said transom bracket and said propulsion unit assembly, and means engaged between said propulsion unit assembly and said link for non-releasably preventing pivotal movement in a vertical plane of said propulsion unit assembly with respect to said link.

2. A marine propulsion device in accordance with claim 1 wherein said means for selectively rectilinearly displacing said propulsion unit assembly displaces said propulsion unit assembly generally vertically.

3. A marine propulsion device in accordance with claims 1 wherein said means connected to said propulsion unit assembly and said transom bracket further includes means pivotally connecting said link to said transom bracket, and releasable means for holding said link against pivotal movement relative to said transom bracket in any selected one of a plurality of angularly displaced locations relative to said transom bracket.

4. A marine propulsion device comprising a transom bracket adapted to be mounted on the transom of a boad, a propulsion unit assembly including a rotatably mounted propelling element, and means connected to said propulsion unit assembly and said transom bracket for selectively rectilinearly displacing said propulsion unit assembly relative to said transom bracket between a running position and a second elevated position spaced from the running position and against other material movement of said propulsion unit assembly relative to said transom bracket, said means comprising a second bracket pivotally connected to said transom bracket for vertical swinging movement about a generally horizontal axis, a link which is carried by said second bracket for extension and contraction relative thereto, and means connecting said link and said propulsion unit assembly for vertically raising and lowering said propulsion unit assembly in response to extension and contraction of said link and for preventing pivotal movement in a vertical plane of said propulsion unit assembly relative to said link.

5. A marine propulsion device comprising a transom bracket adapted to be mounted on the transom of a boat, a propulsion unit assembly including a rotatably mounted propelling element, and means connected to said propulsions unit assembly and said transom bracket for selectively recitinearly displacing said propulsion unit assembly relative to said transom bracket between a running position and a second elevated position spaced from the running position and against other material movement of said propulsion unit assembly relative to said transom bracket, said means comprising a second bracket pivotally connected to said transom bracket of vertical swinging movement about a generally horizontal axis and releasably connected to said transom bracket to prevent vertical swinging movement, a link which is carried by said second bracket for extension and contraction relative thereto, and means connecting said link and said propulsion unit assembly for vertically raising and lowering said propulsion unit assembly in response to extension and contration of said link and for preventing pivotal movement in a vertical plane of said propulsion unit assembly relative to said link.

* * * * *

UNITED STATES PATENT AND TRADEMARK OFFICE

CERTIFICATE OF CORRECTION

PATENT NO. : 4,501,562

DATED : February 26, 1985

INVENTOR(S) : Clarence E. Blanchard

It is certified that error appears in the above-identified patent and that said Letters Patent is hereby corrected as shown below:

Column 7, line 39, "boad" should be -- boat --.

Column 8, line 22, "propulsions" should be -- propulsion --.

Column 8, line 23, "recitinearly", should be -- rectilinearly --.

Signed and Sealed this

*Thirteenth* Day of *August 1985*

[SEAL]

*Attest:*

DONALD J. QUIGG

*Attesting Officer* *Acting Commissioner of Patents and Trademarks*